US005401208A

United States Patent [19]

Marvin

[11] Patent Number: 5,401,208

[45] Date of Patent: Mar. 28, 1995

[54] OYSTER KNIFE

[76] Inventor: Earle R. Marvin, 922 S. Jefferies Blvd., Walterboro, S.C. 29488

[21] Appl. No.: 182,214

[22] Filed: Jan. 14, 1994

[51] Int. Cl.[6] ..... A22C 29/04; A47G 21/06

[52] U.S. Cl. ..... 452/17; 452/13; 30/120.1; 30/356

[58] Field of Search ..... 452/17, 13, 16; 30/111, 30/120.1, 351, 356, DIG. 3, DIG. 8, 49, 308, 142

[56] References Cited

U.S. PATENT DOCUMENTS

| | | | |
|---|---|---|---|
| 27,716 | 10/1897 | Webster | 30/346 |
| 829,353 | 8/1906 | Rand | 452/17 |
| 1,316,962 | 9/1919 | Lawton | 30/356 |
| 2,279,833 | 4/1942 | Madan | 30/356 |
| 3,706,114 | 12/1972 | Waechter | 30/120.1 |
| 4,117,593 | 10/1978 | Piligrino | 30/356 |
| 4,149,313 | 4/1979 | Ishida | 30/351 |
| 5,103,564 | 4/1992 | MacDonald | 30/351 |
| 5,216,812 | 6/1993 | Lyons | 30/120.1 |

FOREIGN PATENT DOCUMENTS

| | | | |
|---|---|---|---|
| 103601 | 1/1942 | Sweden | 30/309 |

*Primary Examiner*—Willis Little
*Attorney, Agent, or Firm*—B. Craig Killough

[57] ABSTRACT

A knife which is used to open shells of oysters and shellfish having a blade which extends from a handle having a void therein, wherein the blade has a relatively flat bottom surface which joins a top surface at a point opposite said handle, and the top surface has a convex shape which forms a point along the edge thereof.

20 Claims, 1 Drawing Sheet

OYSTER KNIFE

FIELD OF THE INVENTION

This invention relates to a knife which is used to remove a shellfish from a shell, such as an oyster from an oyster shell.

BACKGROUND OF THE INVENTION

Oysters and other shellfish grow and reside in shells in saltwater. Oysters and shellfish are harvested from beds in saltwater. Oysters and shellfish are edible, but must be removed from their prior to consumption.

It is common to remove oysters and shellfish from their shells when the oysters or shellfish are raw, or uncooked, or after cooking, such as by steaming. The shells may be difficult to open, particularly when the shellfish are raw. The shells may be opened along a seam within the shells, but it may be necessary to use a sharp object which is inserted in the seam to separate the oyster shell.

In the prior art, oyster knives are used to open shellfish. These oyster knives have the general shape of a typical knife, such as a kitchen knife. The knives have a handle and a blade. A point of the blade is inserted into the seam of the shell, usually near the foot of the oyster or shellfish. Once entry into the shell is made, the knife is rotated or twisted about the blade to open the shell.

Typically, the shell is held in one hand. Oyster shells, in particular, have sharp surfaces which will cut the hands. These hazards are compounded by the application of a large amount of pressure on the point of the oyster knife. If the oyster knife slips from the irregular surface of the shell, the oyster knife can cut or bruise the hand of the user.

SUMMARY OF THE PRESENT INVENTION

The present invention has a handle and a contiguous blade. The blade provides a sharp point which is present where the bottom surface of the blade joins the top surface of the blade. This point is used for separating the oyster shell. The top surface has a convex shape which is formed to a point along the edge, which may be inserted into the oyster shell, and which allows rotation of the knife within the hand to pry the oyster shell open. The relatively flat sides of the blade allow the oyster or other shellfish to be scooped from the shell by means of the knife.

The handle has a void therein through which a finger may be inserted for control of the oyster knife. The handle allows for quick rotation of the knife within the hand for usage of the knife in multiple positions.

The present invention provides on oyster knife having a sharp point for insertion and initial opening of the shell. The convex top surface which is formed to a point allows the knife to be firmly gripped within the hand for opening of shells which do not require the insertion of the sharp point, or which have been initially opened by means of the sharp point. The flat bottom surface prevents damage to the hand while holding the knife within the fist. The handle allows the knife to be quickly rotated into an out of the palm of the hand, while fully controlling the knife.

DETAILED DESCRIPTION OF THE DRAWINGS

DETAILED DESCRIPTION OF THE PREFERRED EMBODIMENT

Figure 1:
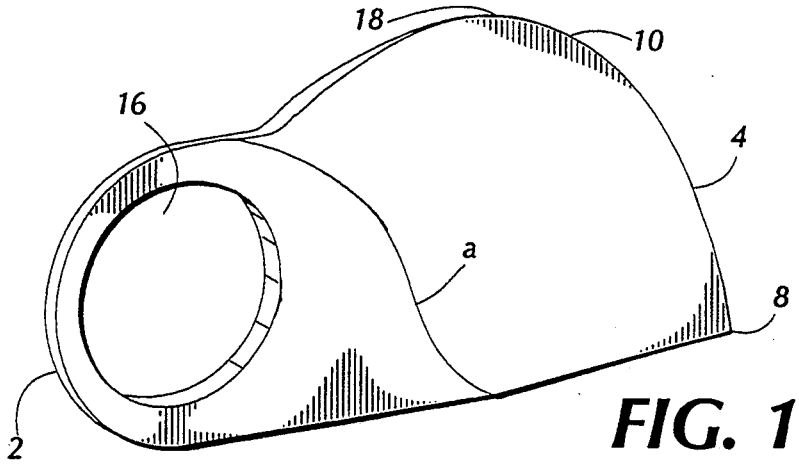
FIG. 1 is a perspective view of the oyster knife.
Figure 2:
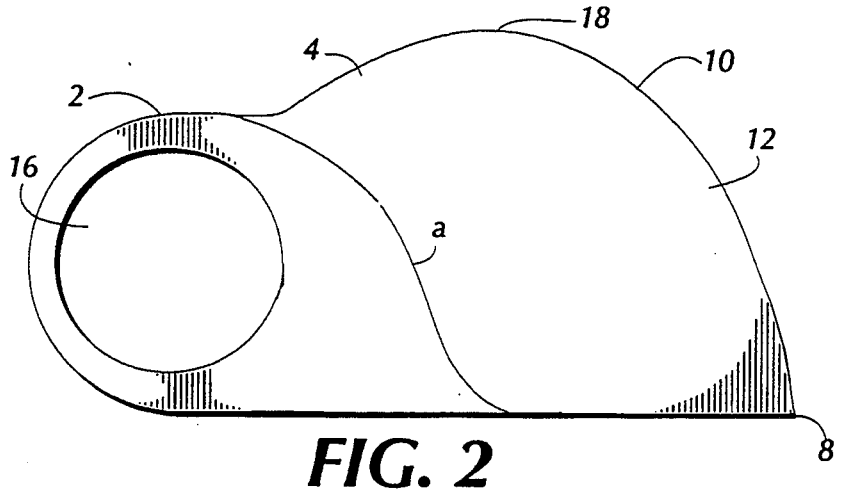
FIG. 2 is a side elevation of the oyster knife.
Figure 3:
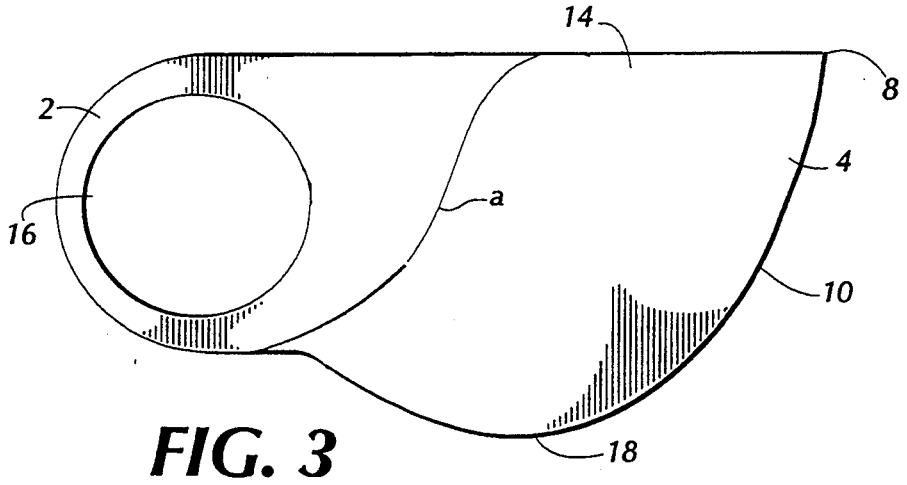
FIG. 3 is a side elevation of the oyster knife which is opposite the side shown in FIG. 2.

Referring now to the drawing figures, the oyster knife has a handle 2 and a blade 4 which are contiguous to each other. In the preferred embodiment, the oyster knife, including the handle and the blade, are formed from one piece of a solid material, such as stainless steel.

Figure 4:
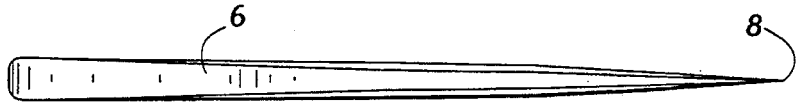
FIG. 4 is a bottom plan view of the oyster knife.

The bottom surface 6 of the oyster knife is relatively flat. FIG. 4. In the preferred embodiment, the bottom surface is relatively straight, and tapers from a relatively continuous width near the handle to a sharp point 8 at the end of the bottom surface which is opposite the handle.

A top surface 10 of the blade extends from the point 8 to the handle 2. Top surface 10 has a convex shape. In the preferred embodiment, the convex shape is of variable radii, producing a steep rise from the point 8 to the uppermost part of the top surface. The top surface extends above the handle, as shown in the drawing figures, before declining to join the handle.

The sides 12, 14 of the device are relatively flat. The sides of the device taper from the handle and the bottom surface 6 to the top surface 10, to form a relatively sharp point along the top surface, in contrast to the relatively flat bottom (FIG. 4) and the handle, which is of relatively constant thickness (FIG. 1). In the preferred embodiment, the taper begins generally at line a, and tapers continuously to form the point of the top surface. Also note that the bottom surface tapers to the sharp point 8 as demonstrated in FIG. 4, and tapers to form the point of the top surface.

The handle is thicker than the blade. In the preferred embodiment, the handle is of relatively constant thickness, although rounded edges of the handle and the void may be provided for comfort and safety. In the preferred embodiment, the thickness of the handle is relatively constant, but begins to taper at line a to form the thinner blade.

The void 16 in the handle is of sufficient size to allow the insertion of an index finger through the void, and should be sufficiently large to accomodate the index finger of virtually any user.

The device may be used to open oysters or shellfish as desired. The point 8 may be inserted to accomplish an initial opening of the shell, usually near the foot of the oyster or shellfish. The point 18 of the top surface 10 may also be used to gain initial entry into the shell. The top surface then provides a means to twist or rotate the knife to completely separate the shell.

In the preferred embodiment, the index finger is inserted through the void in the handle. The oyster knife extends away from the hand, outside of the palm, with the thumb placed above the handle and adjacent to the top surface of the device; and the middle finger on the bottom of the handle, adjacent to the bottom of the device. The device is controlled and steadied by the arrangement of the fingers in this manner. The point 8 of the device, which is extending away from the hand, is then available for insertion into the shell to make an initial opening in the shell. The device may then be rotated about the forefinger for approximately 180 degrees. The device now rests in the palm of the hand, with the user forming a fist. The bottom surface 6 of the knife rests against the palm, with the top surface extending from the hand. The point 18 of the top surface may be used to gain entry into the oyster shell by inserting the top surface into the shell and rotating the wrist back and forth to completely open the shell. If desired, the blade may the be used as a spoon or scoop to scoop the oyster or shellfish from the shell. The blade of the knife, in particular the top surface of the knife, may be used to sever the foot of the shellfish from the shell.

The point of the device provides the point with which to concentrate energy for shells which are particularly difficult to open. The point of the top surface of the blade is used to open shells which are less difficult to open, or to complete the opening of shells which are partially opened, whether from steaming or otherwise. When the knife is held in the palm of the hand, the top surface of the blade extends from the palm of the hand, and the natural rotation of the wrist may be used to force the shell open by means of the blade. This is contrasted with oyster knives of the prior art, which do not allow the blade to be held in the palm of the hand, and subject the hand, particularly the knuckle of the forefinger, to cuts and abrasions from the oyster shell as a great amount of force is applied to the knife, and the knife suddenly penetrates the shell.

What is claimed is:

1. An oyster knife, comprising:

a. a handle having a void therein which is sufficient for placement of a finger therethrough;

b. a blade extending from said handle having a generally flat bottom surface, and having a top surface which joins and extends from an end of said bottom surface which is opposite said handle, wherein a frontal point is formed where said top surface joins said bottom surface, and wherein said top surface extends from said point towards said handle and above said handle, and said top surface is convex in shape, and having relatively flat sides which taper from said handle and said bottom surface to form a point along said top surface.

2. An oyster knife as described in claim 1, wherein said bottom surface is relatively straight.

3. An oyster knife as described in claim 1, wherein said convex top surface is of varying radii from said frontal point to said handle.

4. An oyster knife as described in claim 2, wherein said convex top surface is of varying radii from said frontal point to said handle.

5. An oyster knife as described in claim 1, wherein said void of said handle is a hole which is completely surrounded by said handle.

6. An oyster knife as described in claim 2, wherein said void of said handle is a hole which is completely surrounded by said handle.

7. An oyster knife as described in claim 3, wherein said void of said handle is a hole which is completely surrounded by said handle.

8. An oyster knife as described in claim 4, wherein said void of said handle is a hole which is completely surrounded by said handle.

9. An oyster knife as described in claim 1, wherein said handle is of a relatively constant thickness.

10. An oyster knife as described in claim 2, wherein said handle is of a relatively constant thickness.

11. An oyster knife as described in claim 3, wherein said handle is of a relatively constant thickness.

12. An oyster knife as described in claim 4, wherein said handle is of a relatively constant thickness.

13. An oyster knife as described in claim 5, wherein said handle is of a relatively constant thickness.

14. An oyster knife as described in claim 6, wherein said handle is of a relatively constant thickness.

15. An oyster knife as described in claim 7, wherein said handle is of a relatively constant thickness.

16. An oyster knife as described in claim 8, wherein said handle is of a relatively constant thickness.

17. An oyster knife, comprising:

a. a handle having a void therein which is of sufficient size for placement of a finger therethrough; and b. a blade extending from said handle, wherein said void in said handle is adjacent to one end of said blade, said blade having a bottom surface which extends from said handle and below said void of said handle, and having a top surface which joins and extends from an end of said bottom surface which is opposite said handle, wherein a frontal point is formed where said top surface joins said bottom surface on an end of said blade which is opposite said end of said blade which is adjacent to said void, and wherein said top surface extends from said frontal point towards said handle and above said void in said handle, and said top surface is convex in shape, said blade forming a point along a length of said top surface from said frontal point to a point of said top surface which is above said void.

18. An oyster knife as described in claim 17, wherein said bottom surface is relatively straight.

19. An oyster knife as described in claim 18, wherein said bottom surface is relatively flat.

20. An oyster knife as described in claim 17, wherein said blade has relatively flat sides which taper from said handle and said bottom surface to form said point along said top surface.

* * * * *